United States Patent [19]

Blandford

[11] Patent Number: 4,679,964

[45] **Date of Patent: * Jul. 14, 1987**

[54] OFFSHORE WELL SUPPORT MINIPLATFORM

[75] Inventor: Joseph W. Blandford, Houston, Tex.

[73] Assignee: Seahorse Equipment Corporation, Houston, Tex.

[ * ] Notice: The portion of the term of this patent subsequent to Dec. 17, 2002 has been disclaimed.

[21] Appl. No.: 809,162

[22] Filed: Dec. 16, 1985

Related U.S. Application Data

[63] Continuation-in-part of Ser. No. 622,990, Jun. 21, 1984, Pat. No. 4,558,973.

[51] Int. Cl.[4] ..... E02B 17/02; E02D 31/00

[52] U.S. Cl. ..... 405/216; 405/211; 405/224; 405/227; 166/356

[58] Field of Search ..... 405/195, 203–209, 405/211, 216, 212, 213, 214, 217, 224, 227; 403/104, 373, 377; 166/351, 356, 364, 365, 366, 367; 114/219, 264, 265

[56] References Cited

U.S. PATENT DOCUMENTS

| | | | |
|---|---|---|---|
| 2,447,107 | 8/1948 | Wirgin | 403/104 X |
| 2,517,700 | 8/1950 | Odin | 403/373 X |
| 3,271,963 | 9/1966 | Blenkarn . | |
| 3,389,562 | 6/1968 | Mott et al. | 405/227 X |
| 3,496,728 | 2/1970 | Slack | 405/211 |
| 3,516,259 | 6/1970 | Tokola | 405/208 |
| 3,525,392 | 8/1970 | Lloyd et al. | 405/227 X |
| 3,564,858 | 2/1971 | Pogonowski | 405/214 X |
| 3,605,413 | 9/1971 | Morgan . | |
| 3,793,840 | 2/1974 | Mott et al. . | |
| 3,881,549 | 5/1975 | Thomas | 166/367 X |
| 3,934,658 | 1/1976 | Nelson | 405/204 X |
| 4,273,472 | 6/1981 | Piazza et al. . | |
| 4,283,159 | 8/1981 | Johnson et al. . | |
| 4,339,899 | 7/1982 | Klenk et al. | 405/224 X |
| 4,445,806 | 5/1984 | Crain . | |
| 4,540,314 | 9/1985 | Falkner | 405/227 |
| 4,558,973 | 12/1985 | Blandford | 405/211 X |
| 4,571,123 | 2/1986 | Chandra et al. | 405/224 X |

FOREIGN PATENT DOCUMENTS

| | | | |
|---|---|---|---|
| 611040 | 10/1960 | Italy | 405/208 |

*Primary Examiner*—Cornelius J. Husar
*Assistant Examiner*—Nancy J. Stodola
*Attorney, Agent, or Firm*—Gunn, Lee & Jackson

[57] ABSTRACT

For use with a subsea well incorporating an external conductor pipe extending upwardly above the seabed, a well support miniplatform is set forth. In the preferred and illustrated embodiments, the preferred embodiment describes a longitudinally split, flange equipped, bolt joined elongate conductor clamp supported on a frame at the bottom thereof and having a plurality of appended upstanding braces. The support frame is adapted to be rested on a seabed and held in place by a number of anchors driven into the seabed at corners. The support frame is selectively installed after completion of a well wherein the conductor pipe extends above the seabed. The support frame may subsequently be removed after installation of a permanent platform. In alternate embodiments, the support frame may be installed as a permanent structure. A boat landing and miniplatform may be mounted on the conductor pipe or the conductor clamp supported by the support frame.

20 Claims, 29 Drawing Figures

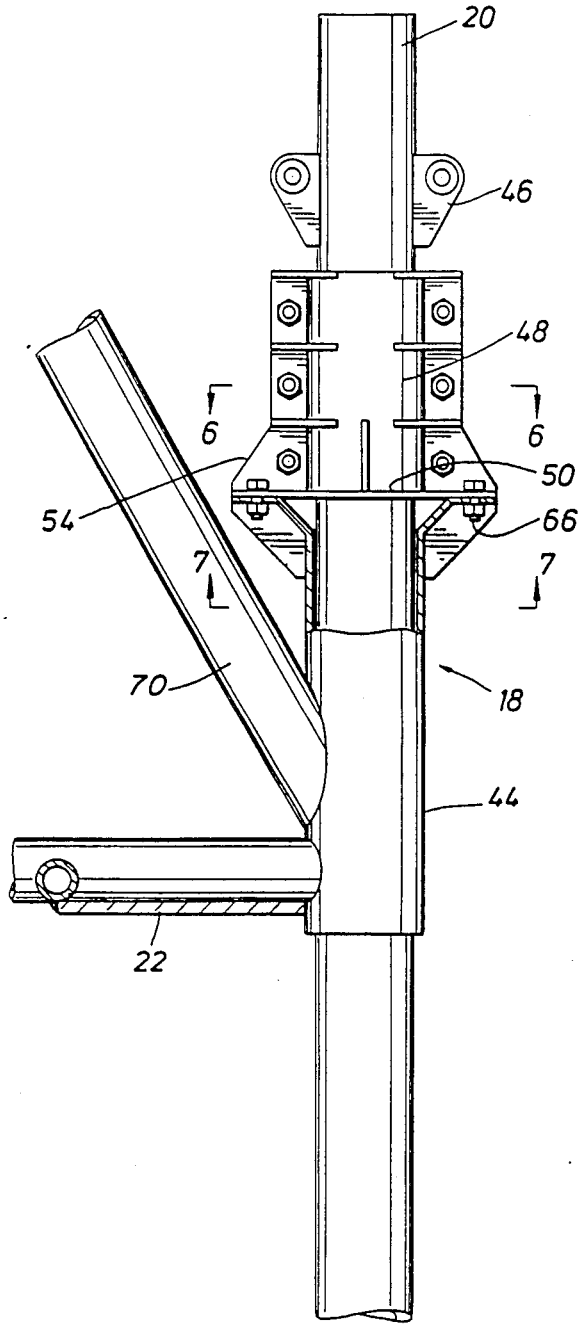
FIG. 5
FIG. 6
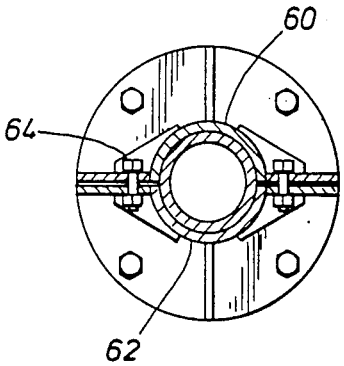
FIG. 7
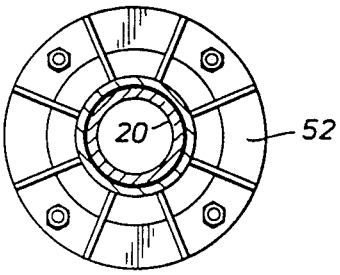
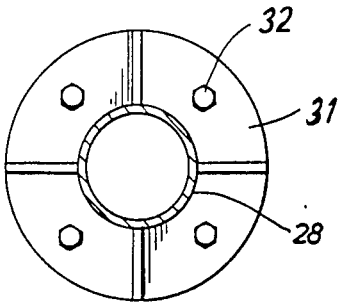
FIG. 8

FIG. 9
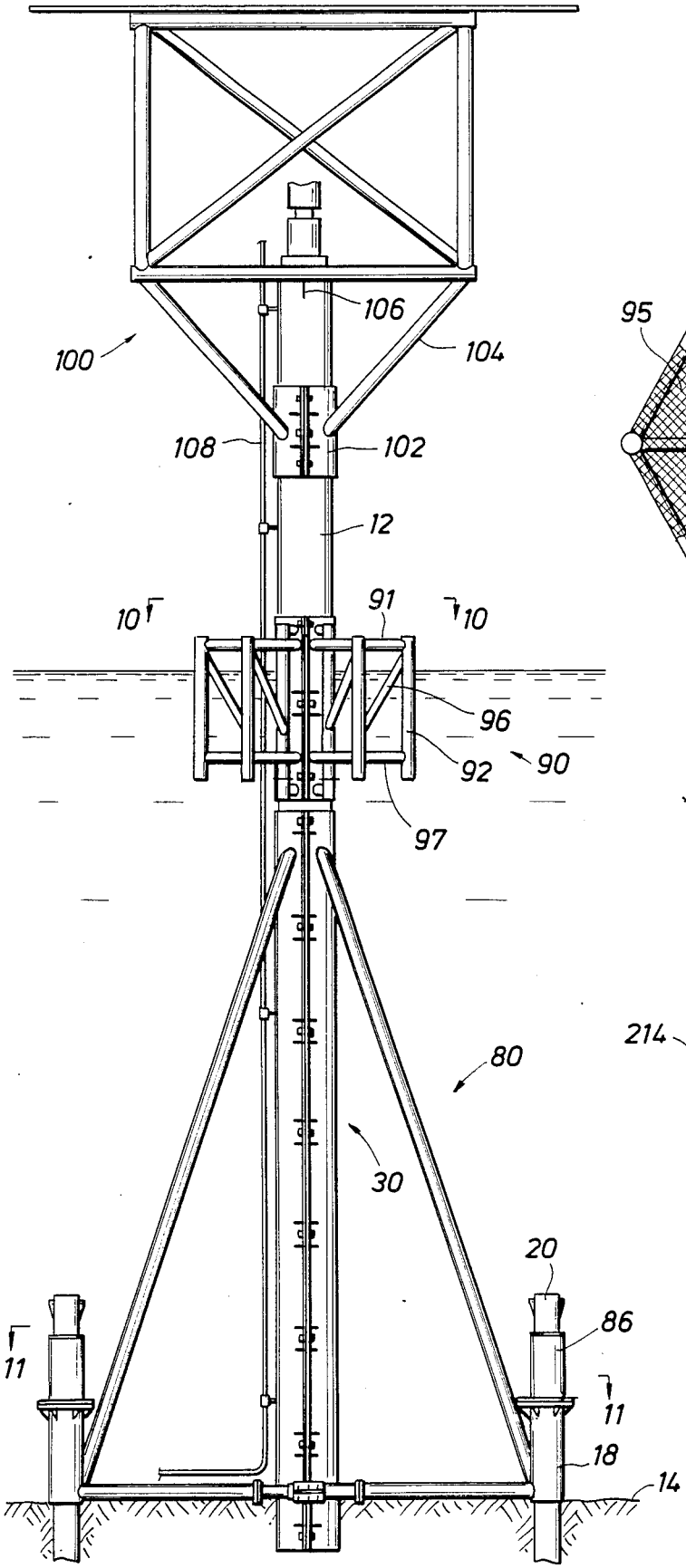
FIG.10
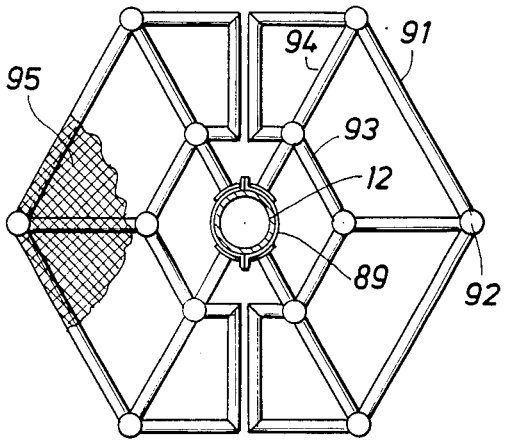
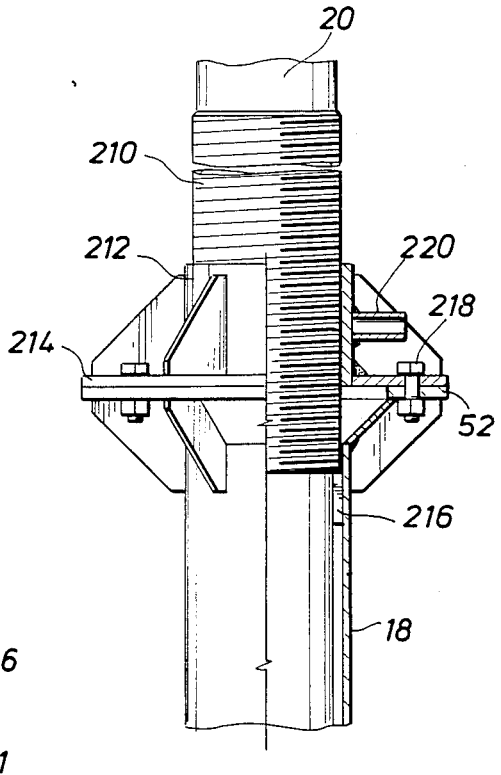
FIG.16

FIG.11
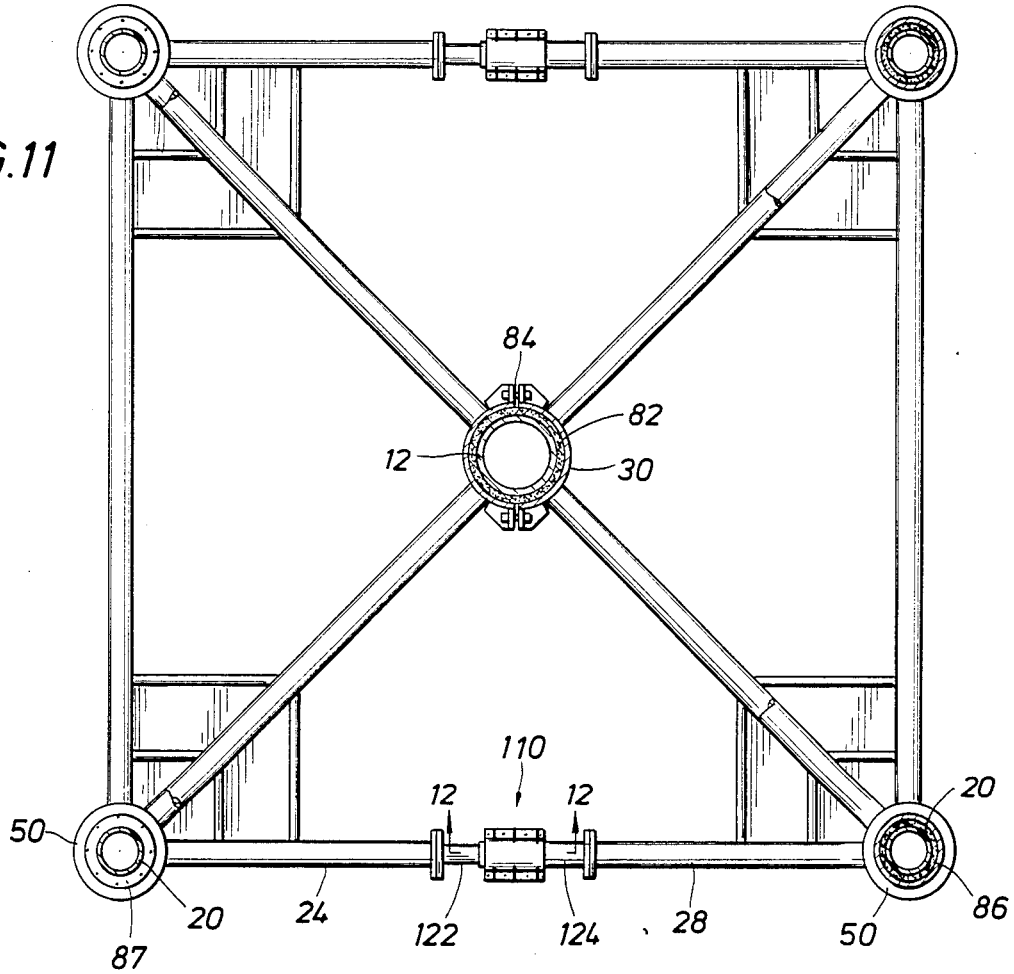
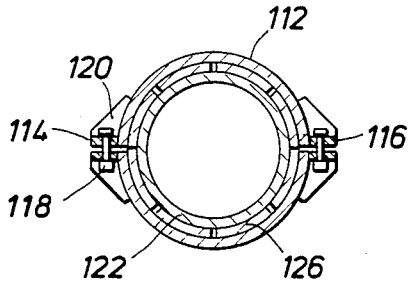
FIG. 13
FIG.12
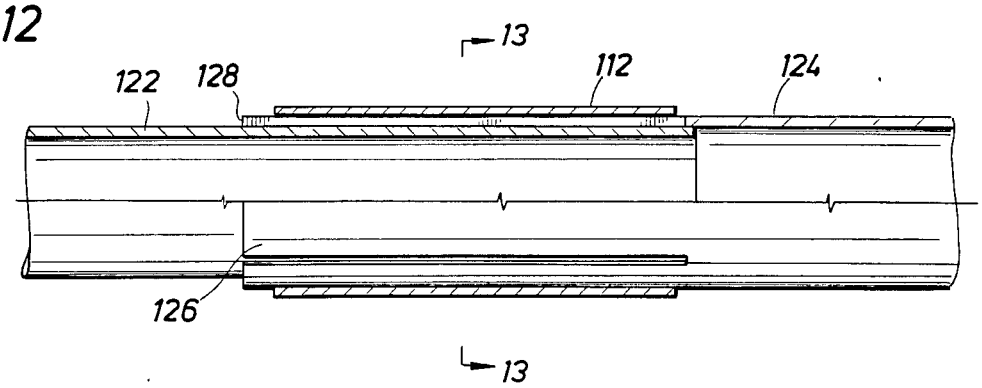

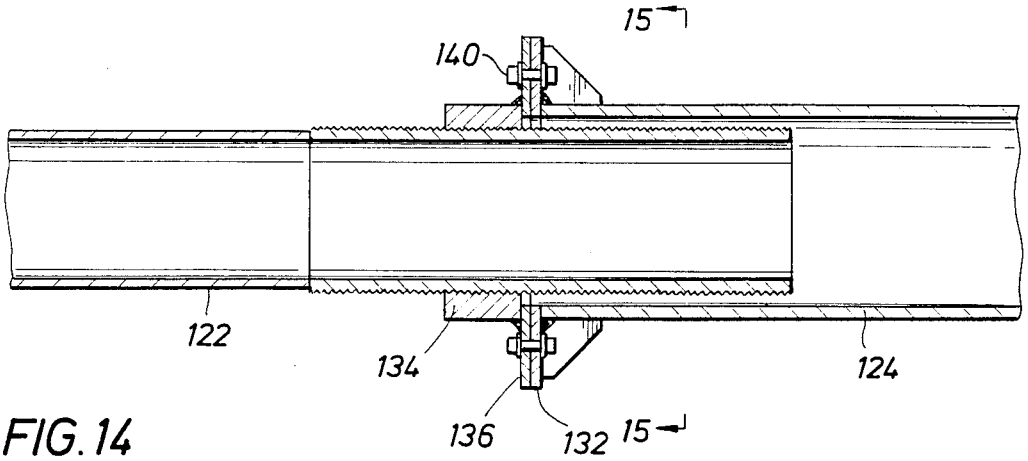
FIG. 14
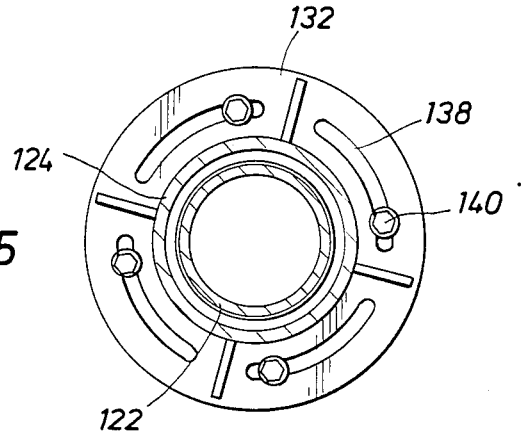
FIG. 15
FIG. 17
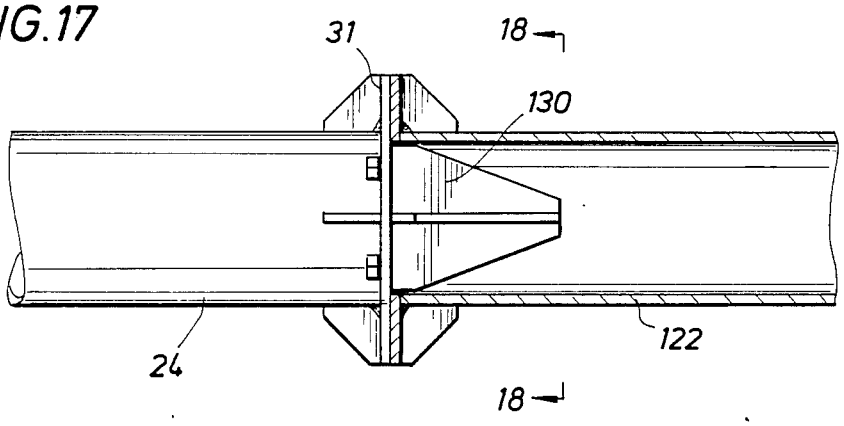
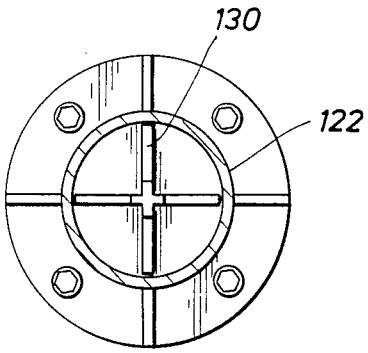
FIG. 18

FIG. 20
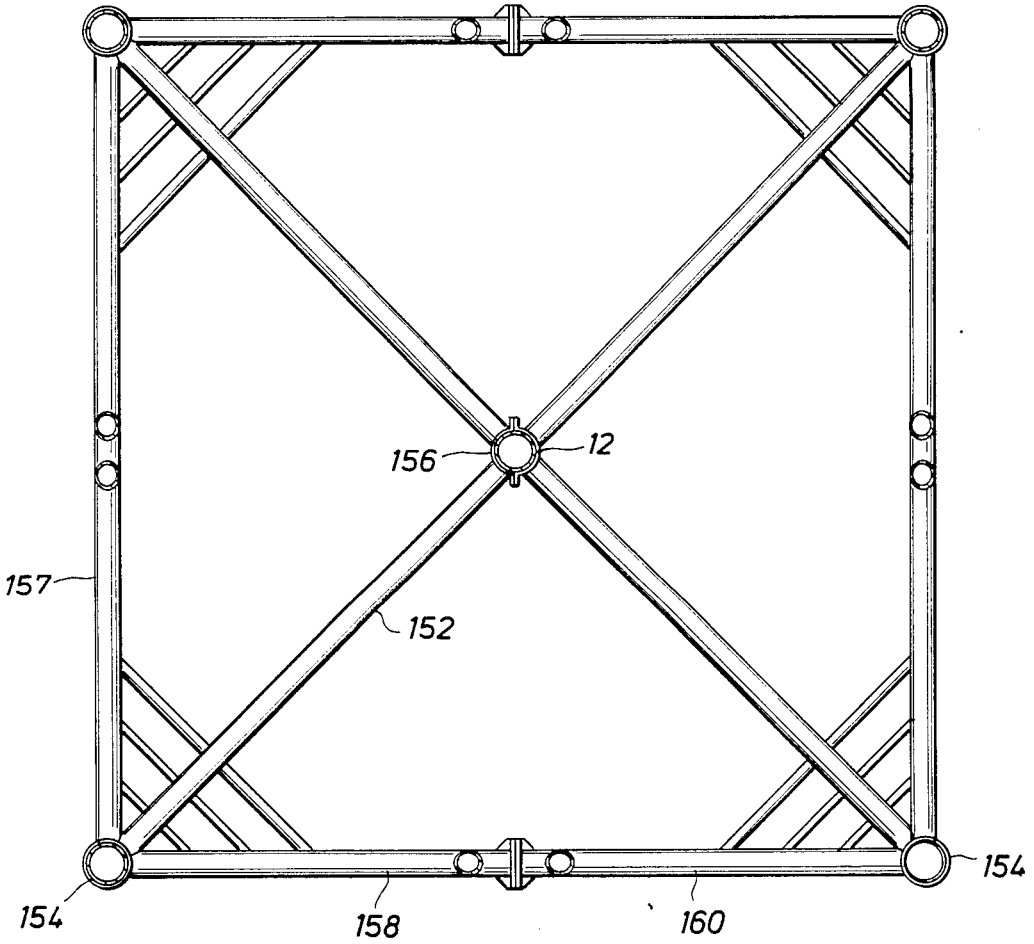
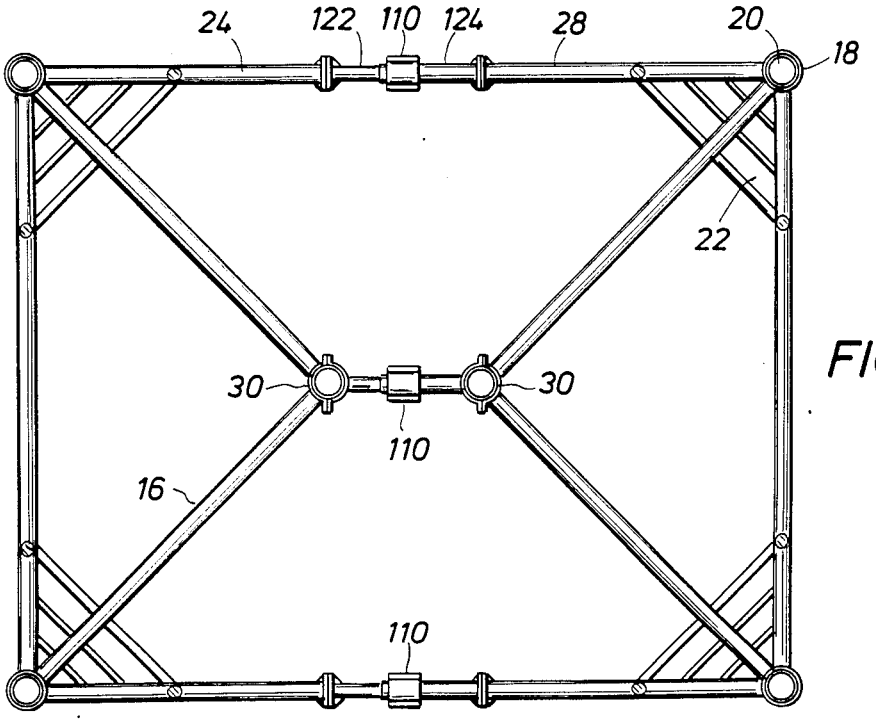
FIG. 22

FIG. 24
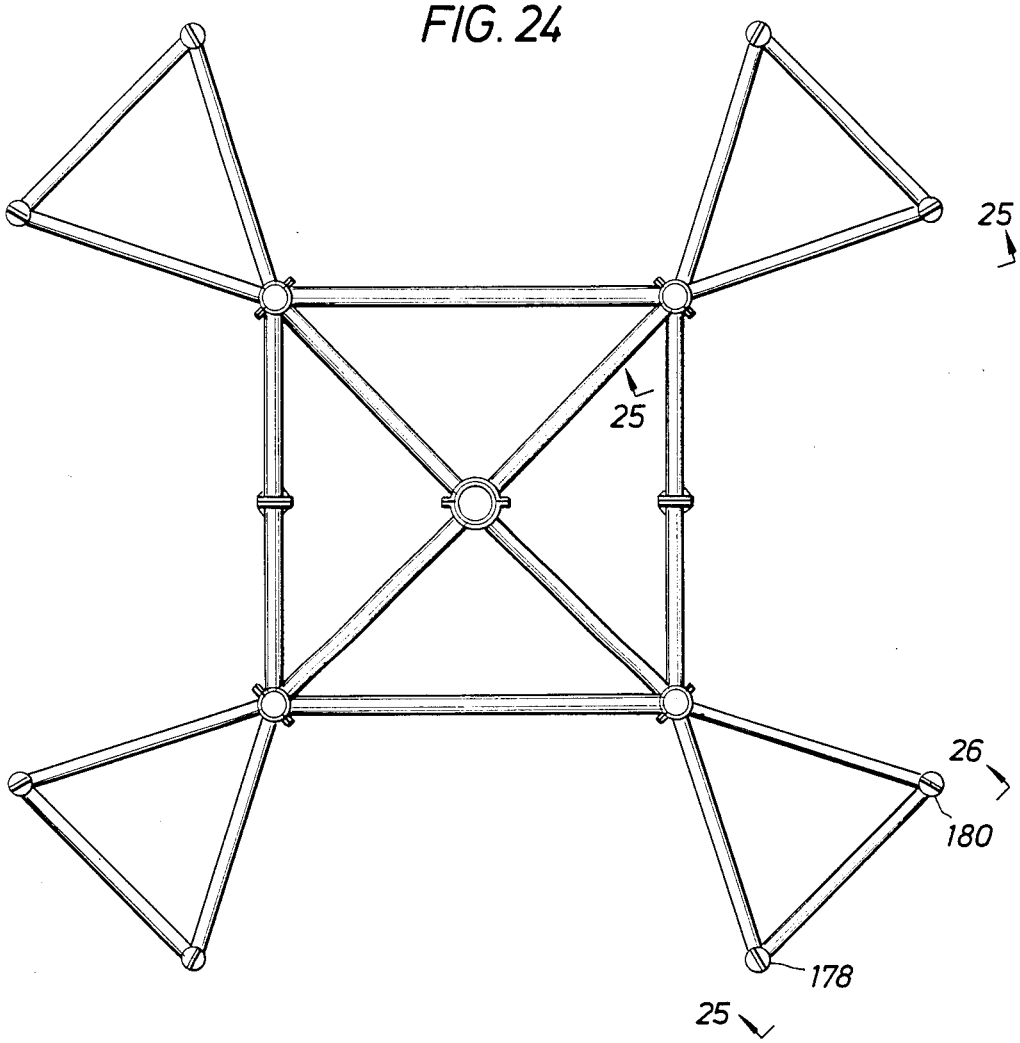
FIG. 25
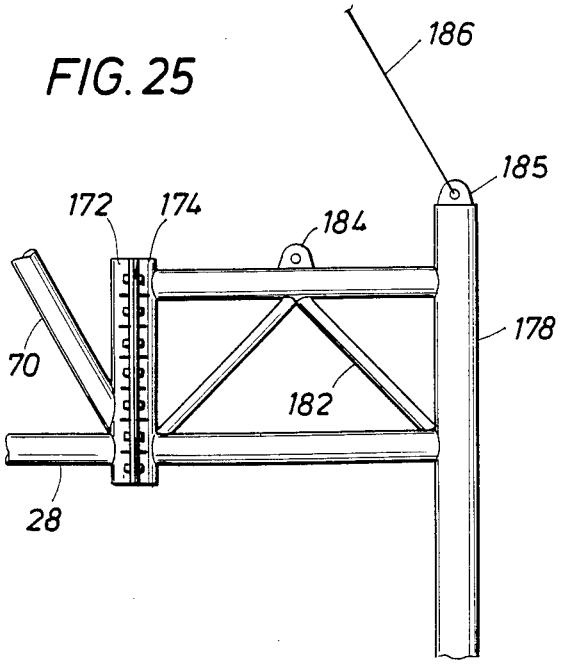
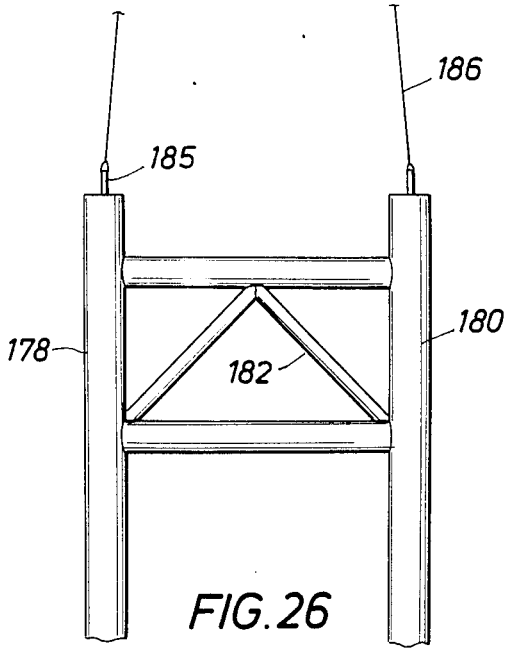
FIG. 26

OFFSHORE WELL SUPPORT MINIPLATFORM

RELATED APPLICATIONS

This application is a continuation-in-part application of U.S. Ser. No. 622,990, filed June 21, 1984, now U.S. Pat. No. 4,558,973.

BACKGROUND OF THE DISCLOSURE

This apparatus is protective equipment to be used with a completed well. This particularly finds application in wells completed at offshore locations. Assume for explanatory purposes that a well is drilled from a jackup drilling rig or perhaps a semi-submersible drilling rig. Assume that the well is drilled in 50 feet of water or more. The vessel which supports the drilling rig remains on location during the drilling process. After the drilling process has been completed, the drilling vessel is then moved to another location to drill another well. At the time that the vessel is on location, the well may be completed, and production verified so that a production platform can be fabricated on shore to be towed to the location later.

Assume that the well is sufficiently productive that it justifies the installation of some type of production platform. In addition, well production equipment can be devised and assembled onshore and subsequently moved to the site of the well for installation onto the production platform at the well site. Without regard to the particular shape or form of the equipment or platform to be subsequently installed, it takes months, typically about one year or so, to get equipment constructed onshore and moved to the offshore location. If the water is 50 feet deep, this might require fabrication of a production platform which stands about 125 feet tall and which weighs several hundred tons. Clearly, such equipment cannot be fabricated quickly and it must be fabricated carefully, typically tailored to the precise circumstances of the particular well so that it can be towed to the location and installed. Sometimes, between 12 and 18 months will pass between the completion of the well and the installation of a permanent production platform.

It is not economically feasible to maintain the drilling rig on location until the platform has been installed. Rather, the drilling rig is moved to another well site to initiate drilling at that location. This requires that the drilling rig leave the scene and leave the well. The departure of the drilling equipment marks the end of drilling activities at the well. It is expedient for the drilling equipment, including the vessel, to be moved to another drilling site immediately after well completion so that it can economically be used in drilling another well. Preferably, the well is left with suitable casing in the hole extending to some selected depth. Production tubing is also typically installed. A conductor pipe typically surrounds the casing and extends into the seabed. For instance, the conductor pipe might be 30 inch diameter pipe and have a length of about 200 or 300 feet. The conductor pipe is typically positioned so that the top of the conductor pipe extends a distance of between 15 and 45 feet above the still water line.

The well is then shut in by installing suitable closed valves or plugs in the well. The drilling vessel departs the area and hence leaves the well substantially unprotected wherein the casing located in the larger conductor pipe is exposed to some degree of risk until the production platform can be fabricated and installed.

The conductor pipe may be unsupported for a length of between 30 and 125 feet inclusive, or even longer.

Various methods have been employed to protect and support offshore wells during the period between drilling and installing a permanent platform. Some wells are cut off just above the mud line and then completed after the permanent platform has been set. Others are supported by large diameter caissons or conductor pipe. Some prior art methods include the installation of a caisson before the well is drilled. If a dry hole is drilled, the cost of the caisson in addition to the normal dry hole expenses are incurred. Other prior art methods include the installation of mud line suspension equipment, leaving the wells free standing and virtually unprotected and unsupported until a permanent platform can be installed. A well left unprotected for a long period of time can be severely damaged from hurricanes or winter storms which may occur while the well is unprotected.

The equipment of the present disclosure is a protective structural system for the otherwise free-standing conductor pipe which visibly extends from the mud line to a predetermined point above the water line. Assume that the conductor pipe protrudes from the seabed, perhaps standing 30 feet above the water line. It is vulnerable to damage from navigating ships in the area, and particularly can be damaged by extreme lateral loads caused by winter storms and summer hurricanes when left unprotected. The present apparatus is a protective structural system which fastens temporarily or permanently onto the conductor pipe. The conductor pipe is typically in the range of about 26 to about 30 inches in diameter and has wall thickness of about one inch. It is susceptible to bending and damage when left unprotected. The conductor pipe is encased and structurally supported by the present system.

The well support system of the present disclosure incorporates a steel tubular split vertical clamp, adapted to securely clamp to the protruding conductor pipe. The conductor clamp is divided into two similar pieces, split along the length thereof, and the two pieces have edge located flange plates which are joined by suitable nuts and bolts. Moreover, the conductor clamp at the lower end is connected with and braced to a rectangular frame suitably fastened to the seabed or to a supporting substructure. It is held in place by piles which are driven through the corners. Moreover, the upper end of the conductor clamp is laterally supported by diagonally positioned braces, the braces extending from the top of the clamp to the pile anchor sleeves at the corner and anchored to the seabed. The clamp is split into two halves along its diameter and the two halves are bolted together surrounding the conductor pipe.

In an alternate embodiment, the well support system of the present disclosure incorporates a permanent support frame for single or multiple wells. The completed well support system is constructed with fabricated modules which clamp tightly around the well conductor pipe. The components of the system include modules for forming a boat landing which may be secured or clamped about the conductor pipe. For multi well configurations, the system can support a deck large enough to accommodate wireline or through-tubing workover units plus a crane large enough to lift such units from a supply boat onto the deck. Thus, eliminating the need for a jackup unit for most routine well workover and maintenance operations. A miniplatform may also be supported on a single well. A cantilevered halideck supported on single or multi well configurations simplifies transportation to and from the location for site supervision and work.

The well support system of the present disclosure may also be used as a temporary support incorporating outrigger modules which may be secured to the support frame clamped about the conductor pipe. Cables secured to the outrigger module and the bottom of the boat landing temporarily provide lateral support while a permanent platform or support system is being fabricated. This system is particularly useful for temporary support of well sites being developed for installation of a complete production platform.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are, therefore, not to be considered limiting of its scope, for the invention may admit to other equally effective embodiments.

FIG. 5 is an enlarged partial side view of one corner of the frame depicting a steel tubular pile that is driven through a pile sleeve at the corner to anchor the apparatus temporarily or permanently in position;

FIG. 6 is a sectional view along the line 6—6 of FIG. 5 showing details of construction of a pile clamp which fastens around the piling;

FIG. 7 is a sectional view along the line 7—7 of FIG. 5 showing details of construction of the pile sleeve guide mechanism;

FIG. 8 is a sectional view along the line 8—8 of FIG. 2 showing a means for joining adjacent halves together to assemble the apparatus;

FIG. 9 is a side view showing an alternate embodiment of the well support system of the present disclosure, including a boat landing and miniplatform installed on a conductor pipe;

FIG. 10 is a sectional view along the line 10—10 of FIG. 9 showing the octagonal frame of the boat landing components of the well support system;

FIG. 11 is a sectional view along the line 11—11 of FIG. 9 showing the rectangular base frame which anchors the well support system to the seabed;

FIG. 12 is a sectional view along the line 12—12 of FIG. 11 showing details of construction of the telescoping frame members of the well support system;

FIG. 13 is a sectional view along the line 13—13 of FIG. 12 showing details of construction of the clamp mounted about the telescoping frame members;

FIG. 14 is a sectional view of an alternate embodiment of the telescoping frame members;

FIG. 15 is a sectional view along the line 15—15 of FIG. 14 showing construction of the clamp in FIG. 14;

FIG. 16 is a sectional view of one corner of the base frame depicting an alternate embodiment of the pile clamp which fastens around the piling;

FIG. 17 is a sectional view of those leg members of the base frame jointed together;

FIG. 18 is a sectional view along the line 18—18 of FIG. 17;

FIG. 20 is a sectional view along the line 20—20 of FIG. 19 showing the rectangular base frame of the well support system of FIG. 19;

FIG. 22 is a sectional view along the line 22—22 of FIG. 21 showing the expanded rectangular base frame of the well support system of FIG. 21;

FIG. 24 is a sectional view along line 24—24 of FIG. 23 showing the base frame of the well support system in FIG. 23;

FIG. 25 is an enlarged partial side view of one corner of the base frame of FIG. 23 depicting the split sleeve connection of the outrigger module to the base frame;

FIG. 26 is an end view along the line 25—25 of the outrigger anchoring component of the well support system shown in FIG. 21.

DETAILED DESCRIPTION OF THE PREFERRED EMBODIMENT

Figure 1:
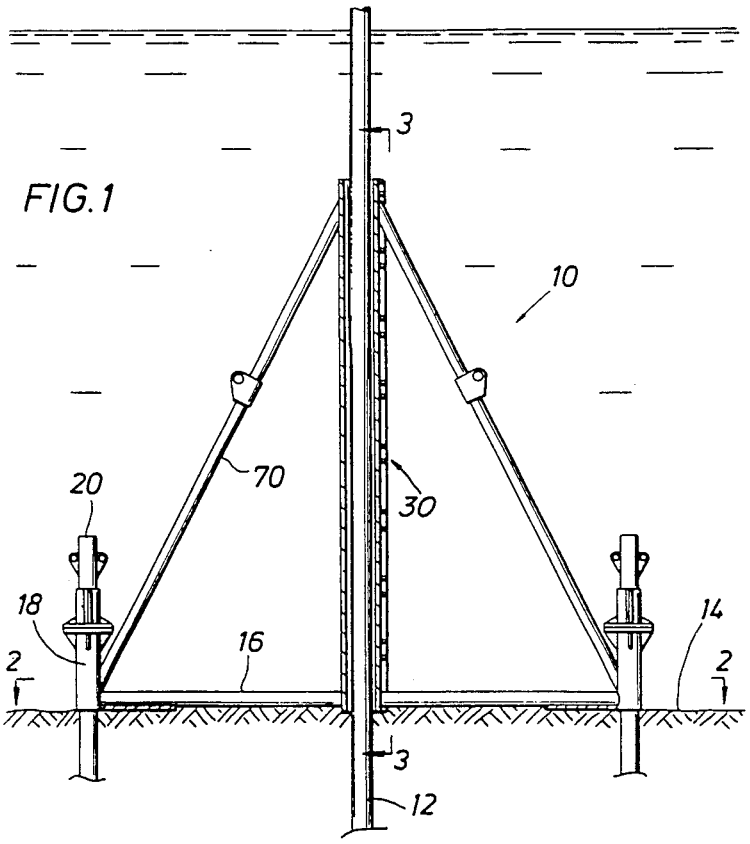
FIG. 1 is a side view showing the protective apparatus of this disclosure installed around a conductor pipe protruding from the bottom of a body of water.

Attention is directed to FIG. 1 of the drawings. In FIG. 1, the protection apparatus 10 of this disclosure is shown installed at a well. Assume that the well has been completed and is evidenced primarily by conductor pipe 12 extending from the seabed 14. Assume further that the conductor pipe is typically quite long, perhaps being a few hundred feed in length. It is typically fabricated of pipe up to about 30 inches in diameter. Assume further that it stands about 20 feet or more above the water line. The conductor pipe 12 is more or less perpendicular to the seabed. It may enclose various and sundry safety or cutoff valves and the like. Primarily, the conductor pipe 12 protrudes vertically above the water and is normally unsupported and is exposed to damage during the interval after the vessel supporting the drilling rig departs the area, and is best protected by the protective apparatus 10 until a permanent production platform can be installed at the wellhead.

Figure 2:
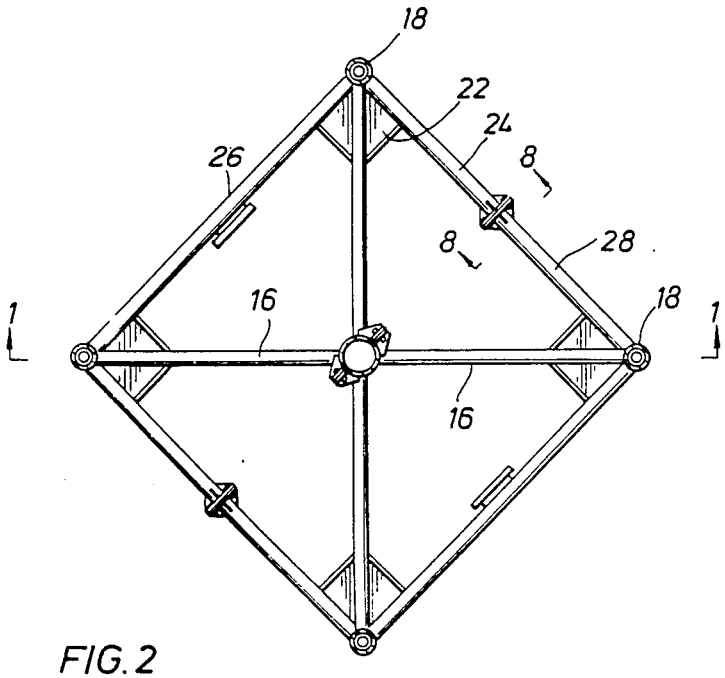
FIG. 2 is a sectional view along the line 2—2 showing the rectangular base frame of the apparatus which anchors the apparatus at the bottom.

The apparatus 10 is therefore a safety device, temporarily installed. It is installed on the conductor pipe 12 for an interval. It is divided into two halves as shown in FIG. 2. In the assembled state, it includes four identical radial frame members 16. The frame members 16 are horizontal, and extend radially outwardly from the center of the equipment to the four corners. At each corner, there is a piling sleeve 18. They are preferably identical. A suitable piling 20 is driven through each corner and extends into the seabed 14. The piling is sufficiently long to be driven sufficiently deep into the seabed 14 to enable each corner of the structure to be anchored. The piling 20 is installed to fasten and later removed to free the safety apparatus 10. As shown in FIG. 2, the piling sleeve 18 is adjacent to a typical angle reinforced mudmat 22 to prevent the device 10 from sinking into the soft seabed before adequate support piles 20 are installed. The frame member 26 is full length, extending from corner to corner of the structure as shown in FIG. 2. The frame member 24 is short, and terminates at a flange fastener. The frame member 24 aligns with a similar frame member 28. The two frame members are joined together by the flanged structure shown in FIG. 8. There, it will be observed that the flange 31 is on the end of the tubular bracing member 28. The flange 31 aligns with a similar flange on the frame member 24. The two flanges are positioned adjacent to one another and are fastened together by suitable nut and bolts 32. The two flange plates assemble the frame member 24 and 28 so that they collectively have a length approximately equal to the length of the frame member 26.

One advantage of the flange connection between the members 24 and 28 is to enable the structure to be broken into two similar halves for ease of shipping, ease of installation, and so the structure can be componentized. This also enables it to protect multiple wells at a single offshore location. In the case of multiple well protection, it is necessary to add a center component to the system to bolt or fasten between halves.

When viewed from above, the frame members define a rectangle which is centered about the conductor pipe 12. The rectangle is constructed with four corners to position four piling sleeves at the respective corners. Thus, the assembled equipment is a rectangle having four sides which are preferably approximately equal, thereby defining a square. The four corners are anchored by suitable pilings 20 which are driven through the four corners which temporarily or permanently stake the apparatus to the bottom. This holds the equipment in location for the time that it is installed. Moreover, it is held stable at the anchored location. The four sides are preferably rectangular, and can even be square so that the sides 24 and 28 are fastened together. The device divides into two halves to enable it to be easily positioned about the conductor pipe 12.

Figure 3:
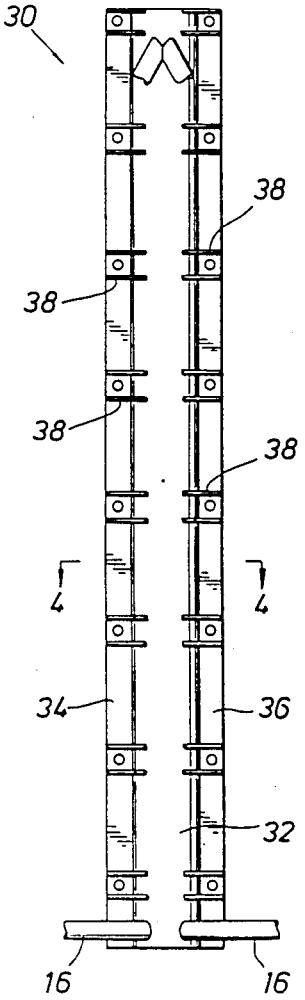
FIG. 3 is a sectional view along the line 3—3 in FIG. 1 showing details of construction of the vertically positioned conductor clamp of this disclosure.
Figure 4:
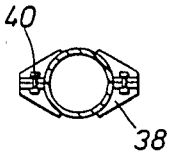
FIG. 4 is a sectional view along the line 4—4 of FIG. 3 showing construction of the conductor clamp in mating halves which fasten together.

The structure incorporates the radially positioned frame members 16. They extend to the four corners and hence are connected to the four piling sleeves 18. The radially positioned frame members 16 fasten at the lower ends of the conductor clamp 30. The conductor clamp 30 is shown in better detail in FIG. 3. There, the conductor clamp comprises a hollow, elongated, split structure also shown in sectional view in FIG. 4. It is formed of identical halves. One half is identified by the numeral 32 and comprises a semicircular sleeve member. it is supported at the bottom by the radial frame members 16. These frame members hold the conductor clamp in an upright position. Moreover, the conductor clamp incorporates edge located flanges 34 and 36. The flanges 34 and 36 are positioned adjacent to mating flanges on the symmetrical half so that the conductor clamp can be fabricated and joined together. The flanges 34 and 36 are stiffened by suitable reinforcing gussets 38. The reinforcing gussets 38 are incorporated for the purpose of stiffening the connecting flanges 34 and 36 so that they will not bend. At suitable locations, the flanges 34 and 36 are drilled with matching sets of holes to enable fasteners such as nuts and bolts to assemble the two halves into the conductor clamp. In FIG. 4, nuts and bolts are identified at 40 for fastening the two halves together. This assembles the conductor clamp 30.

It will be observed in FIG. 1 that the conductor clamp 30 is designed so that it fits snugly around the conductor pipe. When the nuts and bolts are used to assemble the two halves, they are pulled tightly together and bolted around the conductor pipe. Moreover, this conductor clamp extends slightly below the radial frame members 16. This enables the lower end of the device to embed into the mud. The upper end typically stands shorter than the conductor pipe just below the water line, and reduces the unbraced length of the conductor pipe to enable it to carry greater lateral loads than if standing alone. The conductor clamp may, however be secured about the full length of the conductor pipe, if desired, for additional reinforcement. The conductor pipe is thus stiffened and reinforced by the conductor clamp 30. The conductor pipe is firmly held within the conductor clamp 30. As an example, assume that the conductor pipe has a 30 inch OD and that the conductor clamp 30 has a 30 inch ID. It is fastened around the conductor pipe and made snug against the pipe by tightening the nuts and bolts along the flanges. This enables assembly of the sleeve around the conductor pipe in the field. The conductor clamp may be loosened and stabbed over the well conductor, or it may be disassembled and installed onto the well conductor pipe in two pieces. If the device is installed in two pieces or halves, one half is first positioned adjacent to the conductor pipe 12 and set on the seabed 14, and the second half is thereafter positioned on the opposite side. Once they are in positioned, suitable nuts and bolts are used to fasten the two halves together, thereby securing the conductor clamp around the conductor pipe and holding it securely in position. The conductor clamp 30 is sized so that it fits snugly around the conductor pipe 12 so that the two are fastened together in concentric relationship, thereby anchoring the device. This aids and assists in stability of the safety device fastened around the conductor pipe 12.

Attention is directed momemtarily to FIG. 5 of the drawings where the piling sleeve 18 is shown in greater detail. It comprises an upstanding sleeve 44 which is located at each corner of the rectangular frame as shown in FIG. 2. The steel mudmats and support angles 22 are affixed to the sleeve 44 and lower bracing member 24 and 26 (FIG. 2). The sleeve 44 is approximately perpendicular to the plane. The four corners of the frame are thus all equipped with similar sleeves, and they are preferably parallel to one another so that pilings 20 can be driven through them in parallel fashion. Each piling 20 shown in FIG. 5 has a set of two protruding lifting eyes at 46 to enable the piles to be removed at a later date. The lifting eyes are located at a distance from the upper end of the piling so as not to interfere with the pile driving apparatus. The piling 20 is typically driven by suitable means into the soil below the sleeve 44 so that it is anchored.

The piling is first driven through the sleeve 44. After that, it is fastened. It is held in place relative to the equipment by means of a fastener better shown in FIGS. 6 and 7. Briefly, the sectional view of FIG. 7 is through a flanged pile clamp 48 secured above the sleeve 44. The flanged pile clamp 48 supports a protruding flange plate 50 shown in FIG. 5. On the bottom side, it fastens to a matching flange plate 52 which is attached to the upper end of the sleeve 44. On the top side, the flange 50 is supported by a set of reinforcing gussets 54. Bolt holes in the flange plates 50 and 52 are slotted to enable installation tolerances. The pile clamp 48 is split into two halves, the two halves being shown in FIG. 6. The halves are identical to one another and bolt together. They constitute a clamp mechanism for fastening around the piling 20. The clamp mechanism is thus formed of a first upstanding sleeve half 60 and a mating sleeve half 62. They are constructed with edge located flanges in the same fashion as shown in FIG. 3 and are pulled together and clamped by nuts and bolts. The two halves are thus pulled together and fastened snugly around the piling 20. Assume for purposes of discussion that the piling is 70 feet in length. Assume further that it is necessary to install the piling with about 52 feet protruding into the seabed. In that event, the piling is driven through the apparatus shown in FIG. 5 with the sleeve halves 60 and 62 loosely fastened or removed temporarily. After the piling has been driven to the predetermined penetration into the mud, the sleeve halves shown in FIG. 6 are fastened together and are pulled together to clamp around the piling. This typically is accomplished by first tightening the nuts and bolts indicated at 64. After that has been completed, the nuts and bolts at 66 are anchored to fix the sleeve snugly, firmly and tightly, around the piling. At this point, the pile clamp 48 may be welded to the pile around the top of the clamp if the installation is to be permanent or long term.

This apparatus is installed by moving it to the offshore location of the in-place conductor pipe. At the time of installation, it is installed by positioning separate halves adjacent to the conductor pipe 12, or by stabbing over the conductor pipe. Each half stands upright and is braced vertically by means of upstanding diagonal braces 70 and horizontal braces 16. Diagonal braces fasten at the upper ends to the top of the conductor clamp 30. They fasten at the lower ends to the respective corner located pile sleeves 18. The upstanding diagonal braces define a triangular construction as viewed from the side in FIG. 1 to produce a rigid structure. This rigid structure supports the conductor clamp in fixed relationship to the remainder of the structure so that the conductor pipe is not bent. Viewing FIG. 2, the two halves are thus installed so that they are located on opposite sides of the conductor pipe 12. The two halves are then bolted together at the conductor clamp 30 shown in FIG. 3. The nuts and bolts used to accomplish the fastening are tightened, but not snugly. The edge located frame members 24 and 28 are fastened tightly together, this occurring at two locations as shown in FIG. 2. This then assembles the structure around and adjacent to the conductor pipe. At this time, the pilings 20 are driven through the respective four corners. They are driven to a suitable depth to assure that the protective device 10 is anchored. The four corners are then made fast by tightening the bolts 64 and 66 shown in FIGS. 5 and 6. This anchors the four corners. The conductor clamp 30 is then bolted tightly along its length to pull snug around the conductor pipe. This completes installation of the anchor equipment, and secures the device snugly to the conductor pipe. At the time of removal, it is disassembled in the reverse sequence so that the two halves can be installed and removed in relative rapid order. After installation, the conductor pipe and hence the well for the pipe is reasonably secure against unintended damage. Moreover, this installation can be left at an offshore well location indefinitely to protect the well for a long period of time.

Referring now to FIG. 9, an alternate embodiment of the well support system of the present disclosure is shown. The well support system comprises the conductor pipe structural support frame extending from the seabed 14 about the conductor pipe 12 and generally identified by the reference numeral 80. The boat landing 90 is secured to the conductor pipe 12 at the water line. A miniplatform 100 is secured to the upper end of the conductor pipe 12 generally about 30 feet above the still water line to complete the well support system of the embodiment shown in FIG. 9.

The support frame 80 shown in sectional view in FIG. 11 is structurally substantially identical to the support frame 20 described and shown in FIGS. 1–4 above, and therefore, the same reference numerals have been used to identify substantially identical structural elements. The conductor clamp 30 is positioned to clamp about the conductor pipe 12 as previously described. However, in the embodiment of FIG. 9, the conductor clamp 30 is designed so that it does not directly contact the conductor pipe 12. When the nuts and bolts are used to assembly the two halves of the clamp 30 about the conductor pipe 12, an annular space is defined between the clamp 30 and the pipe 12. The annular space is filled with grout 82 as shown in FIG. 11. The annular space is filled with grout by extending a tube (not shown in the drawings) in the annular space to the bottom thereof adjacent the seabed 14. Air is pumped through the tube to remove the water in the annulus. Thereafter, grout 82 or a similar substance is pumped into the annulus and filled to the top of the clamp 30. A neoprene seal 84 clamped between the flanges of the clamp 30 seals the annulus so that the clamp is airtight enabling the removal of water from the annulus. The lower end of the clamp 30 is extended a short distance so that it is embedded in the seabed 14 to seal off the bottom of the annulus. The configuration of the clamp 30 in FIG. 9 is adapted for use with different size conductor pipe. The diameter of conductor pipe will typically be in the range of 26–30 inches. The design of FIG. 9 permits the use of stock material instead of specially rolled pipe to fabricate the clamp 30, thus reducing the cost of fabrication. In addition, the grout 82 increases the cross sectional area of support provided to the conductor pipe 12 and thus increasing section modulus, and thereby further reducing the effects of lateral forces on the conductor pipe 12.

Figure 28:
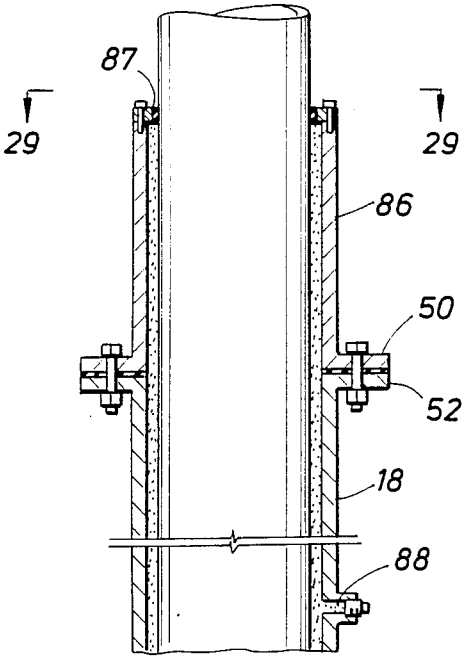
FIG. 28 is an enlarged partial sectional view depositing a tubular pile that is driven through an alternate embodiment of a pile sleeve.
Figure 29:
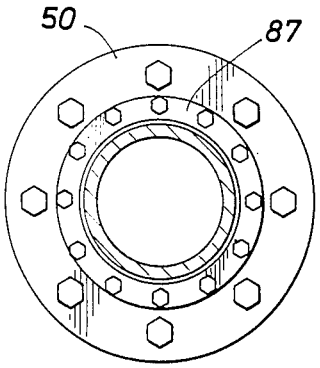
FIG. 29 is a sectional view along the line 29—29 of FIG. 28.

The piling sleeve 18 shown in FIG. 9 also incorporates an internal diameter which is greater than the outside diameter of the piling 20. The piling 20 is driven into the seabed 14 as discussed above, so that upon installation of the piling 20 through the sleeve piling 18, an annular space is formed therebetween. A flange clamp 86 is provided which includes a cylindrical body open at both ends to loosely fit about the pile 20. The clamp 86, best shown in FIGS. 28 and 29, supports a protruding flange plate 50 for fastening to the matching plate 52 attached to the upper end of the pile sleeve 18. A tapped hole 88 is provided adjacent the lower end of the piling sleeve 18 permitting access to the annular space between the sleeve 18 and pile 20. The tapped hole 88 is plugged to close off the annular space after air is pumped in to remove the water and grout is pumped in to fill the annular space. The open end of the clamp 86 is closed by a slip ring 87 slipped about the pile 20 prior to driving it through the pile sleeve 18. The slip ring 87 fits snugly about the pile 20 and includes a vulcanized rubber ring for sealing engagement with the pile 20. The slip ring is adjusted along the pile 20 to engage the top edge of the clamp 86 and screwed thereon in threaded holes spaced about the top edge of the clamp 86 to seal the annular space between the sleeve 18 and pile 20.

Referring again to FIG. 11, it will be observed that the legs 24 and 28 are joined together by a horizontally adjustable clamp 110. The clamp 110, shown in sectional view in FIG. 13, is a split clamp comprising two identical halves 112. The halves 112 are semiconductor members terminating at edge located flanges 114 and 116. The flanges 114 and 116 are joined together by nuts and bolts 118 and are reinforced by gussets 120.

The clamp 110 secures two horizontally adjustable frame members 122 and 124. The frame member 122 telescopes within the frame member 124 permitting horizontal adjustments to be made to the side of the frame structure formed by the leg members 24 and 28. At times, it may not be possible to anchor the frame of the invention to the seabed 14 to form a true rectangle or square. The clamps 110 permit two sides of the support frame to be adjusted so that the conductor clamp 30 may be securely mounted about the conductor pipe 12.

The frame members 122 and 124 terminate at flange fasteners for alignment and connection to the flange members of the leg members 24 and 28, respectively. The two flanges are positioned adjacent to one another and are fastened together by suitable nuts and bolts. The leg member 124 is slotted about of about one end to define a plurality of fingers 126. The slots extend inwardly from the open end 128 of the leg member 124 a sufficient distance so that the fingers 126 may flex inwardly and grab the leg member 122 which is telescoped within the leg member 124. The clamp 110, as shown in FIG. 12, encloses the slotted portion of the leg member 124. The clamp 110 is designed so that upon assembly the two halves 112 are pulled together by the nuts and bolts 118 around the fingers 126 forcing them into gripping engagement with the leg member 122. The two clamps 110 and telescoping leg members 122 and 124 connect the leg members 24 and 28 to complete the assembly of the structural support anchored to the seabed 14.

The well support system of the present disclosure comprises a number of modules or components which are typically assembled below the water surface. It will be observed that the components of the invention are assembled with nuts and bolts which requires the alignment of matching sets of holes drilled in the components. To enable quick and easy alignment of components, leg members terminating in a flange connection are provided with an extension 130, best shown in the sectional views of FIGS. 17 and 18. The extension 130 permits the divers to easily stab the hollow leg member 122 and guide the mating flange plates into engagement for connection by nuts and bolts. The extension 130 in side view presents a cone-like profile formed by at least two angular members at right angle to each other.

In FIG. 14 and 15, an alternate clamp for joining the leg members 122 and 124 is shown. The leg member 124 is hollow as in FIG. 12 and terminates at a flange connection 132. The end of the leg member 122 which telescopes within the leg member 124 is externally threaded for threadably receiving a nut 134. Upon adjusting the leg members 122 and 124 for the proper alignment required, the nut 134 which incorporates a mating flange 136 is advanced so that the flanges 132 and 136 are in contact. It will be observed in FIG. 15 that the flange 132 incorporates a plurality of slots 138 to insure alignment with the drilled holes in the flange 136. The nuts and bolts 140 fasten the flange plates 132 and 136 together.

Referring now to FIG. 16, an alternate embodiment of the pile guide flange connection is shown. Recall that the corners of these support frames are anchored to the seabed 14 by piles 20 driven through the pile sleeves 18. In the embodiment of FIG. 16, the pile 20 includes an externally threaded portion at 210. A nut 212 is threaded about the pile 20 prior to installation. The nut 212 terminates at a flange 214 for mating engagement with the flange 52 of the pile sleeve 18. A plurality of weld stops 216 are welded on the interior of the pile sleeve 18 adjacent the flange 52. The pile stops 216 limit the passage of the pile 20 through the pile sleeve 18 by engaging the lower end of the threaded portion 210 which is formed on an enlarged portion of the pile 20. The pile stops 216 enable positioning of the threaded portion 210 so that the nut 212 may be advanced for connection to the flange 52. Nuts and bolts 218 are used to connect the flanges together. A socket 220 is provided on the nut 212 for receiving a lever handle to aid making up the connection.

Referring again to FIG. 9, the boat landing 90 mounted to the conductor pipe 12 is of similar modular design. That is, the frame of the boat landing 90 is split into two halves and welded to a semicircular clamp 89 as shown in FIG. 10. The clamp 89 is designed so that it fits snugly around the conductor pipe 12. Nuts and bolts are used to assemble the two halves of the clamp 89. They are pulled tightly together and bolted around the conductor pipe 12, thereby mounting the boat landing 90 to the conductor pipe 12 at a predetermined level so that the boat landing 90 extends above the water line. The boat landing 90 comprises a frame work formed by a multiplicity of frame members. For illustrative purposes only, in FIG. 10, the boat landing 90 is shown as being hexagonal in shape. Other shapes, such as rectangular or square may also easily be formed. The outer perimeter of the boat landing 90 is defined by horizontally extending members 91 connected to vertical members 92. An inner perimeter is formed by a plurality of horizontal members 93 which are parallel to the outer members 91. Horizontal connecting members 94 complete the frame work for supporting a grate 95 which forms the boat landing platform. A plurality of angularly extending members 96 connect the upper end of the vertical members 92 to the clamp halves 89 mounting the boat landing 90 to the conductor pipe 12. The lower ends of the legs 92 are welded to the clamp halves 89 by horizontal members 97 so that the legs 92 are substantially parallel to each other and to the longitudinal axis of the conductor pipe 12.

Positioned on the conductor pipe 12 above the boat landing 90 is a miniplatform 100. The platform 100 mounts to support brackets 102 which are first installed on the conductor pipe 12. The support brackets 102 incorporate a plurality of upwardly and angularly extending support members 104. The platform is lowered onto the support members 104 and bolted or welded thereto. Additional support brackets 106 may be welded to the conductor pipe 12 to provide additional support for the deck of the miniplatform 100. Production equipment may be preinstalled on the miniplatform 100 so that all that remains after completion of the installation procedure is to connect the well to the production equipment.

Well fluids are produced through the conductor pipe 12 and directed to onshore or offshore production facilities through a riser pipe 108. Sections of the riser pipe 108 may be prefabricated or preinstalled on one half of the conductor clamp 30 as shown in FIG. 9. After installation of the boat landing 90 and the miniplatform 100, the upper end of the riser 108 is connected to the wellhead equipment on the miniplatform. The lower end of the riser 108 is connected to a production line or flow line (not shown in the drawings) to a remote production facility.

Figure 19:
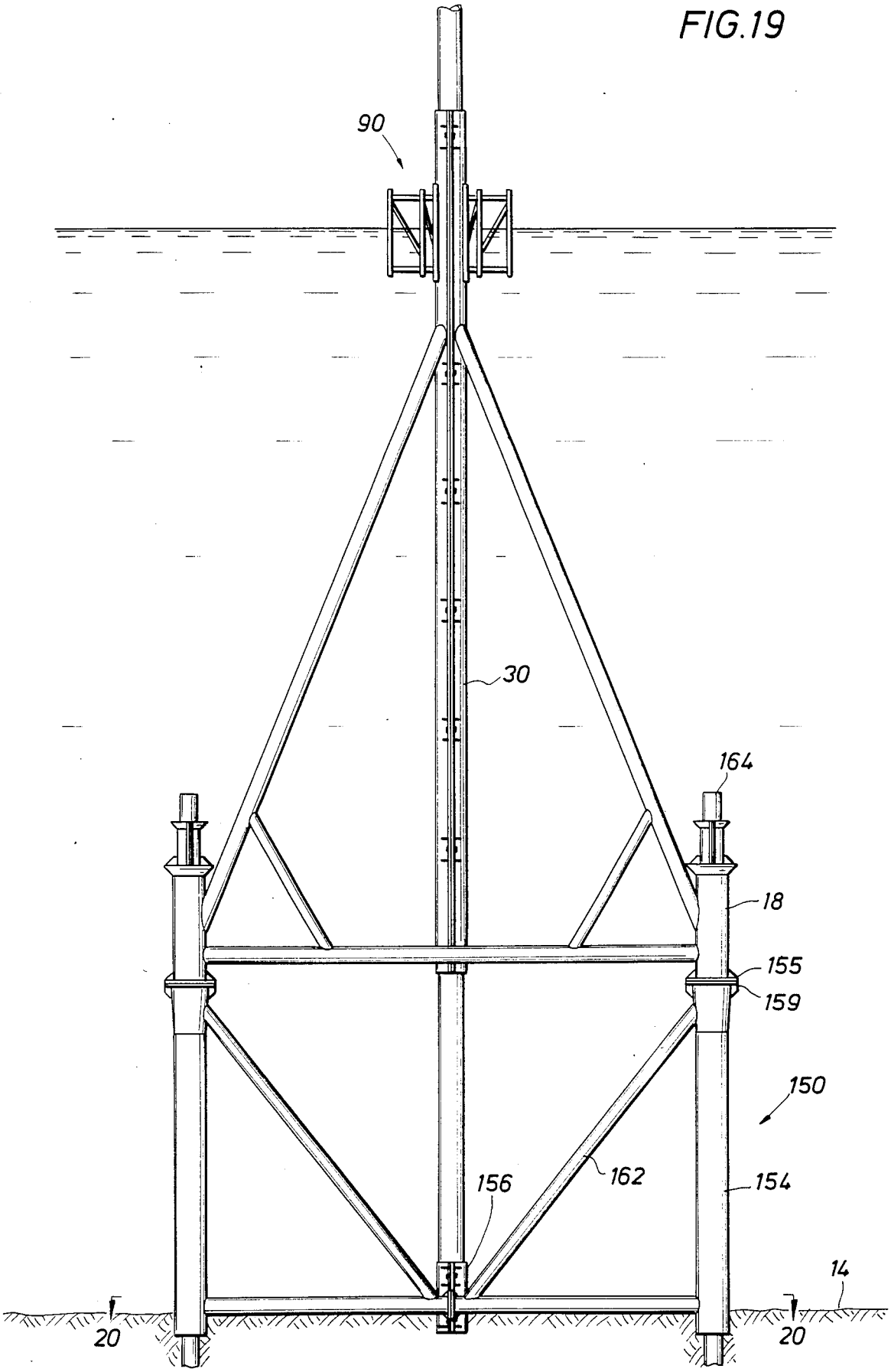
FIG. 19 is a side view of an alternate embodiment of the well support system of the disclosure for use in deep water.

Referring now to FIGS. 19 and 20, a deep water configuration of the invention is disclosed. It will also be observed that the conductor clamp 30 in FIG. 19 extends above the boat landing 90. The modular components forming the boat landing 90 are mounted directly to the conductor clamp 30. The clamp 30 may extend up to any desired height about the conductor pipe 12 as required. In deep water, it may be desirable to incorporate a subplatform, generally identified by the reference numeral 150. The subplatform 150 incorporates radially positioned frame members 152 which extend to the four corners of the subplatform 150 frame structure and connect to piling sleeves 154. The inner ends of the radially extending frame members 152 connect to a split clamp which clamps about the conductor pipe 12. The split clamp is formed by two identical halves 156 and extends a short distance above and below the seabed 14. The split clamp 156 may be extended to meet the lower end of the conductor clamp 30, if desired. However, to reduce expense the weight of the modular components of the substructure 150, the clamp halves 156 in FIG. 19 do not completely enclose the full length of the conductor pipe 12. The frame member 157 is full length, extending from corner to corner of the substructure 150 shown in FIG. 20. The frame members 158 and 160 are short and terminate at mating flange connections which are joined together to complete the asembly of the substructure 150. Vertical bracing is provided by diagonal braces 162 which extend from the the corner pilings 154 to connect to the frame members 157, 158 and 160.

In the embodiment of FIG. 19, the substructure 150 is first installed about the conductor pipe 12, then the two halves of the conductor clamp 30 are lowered and the corners thereof are aligned with the four corners of the substructure 150. The lower end of the piling sleeves 18 terminate in mating flange plates 155 which are bolted to the flange plates 159 of the pile sleeves 154. The piles 164 are then driven through the aligned pile sleeves 18 and 154 into the seabed 14 and anchored to the upper end of the piling sleeves 18 as previously described. Installation of the conductor clamp 30 is completed in the manner described regarding FIGS. 1–4.

Figure 21:
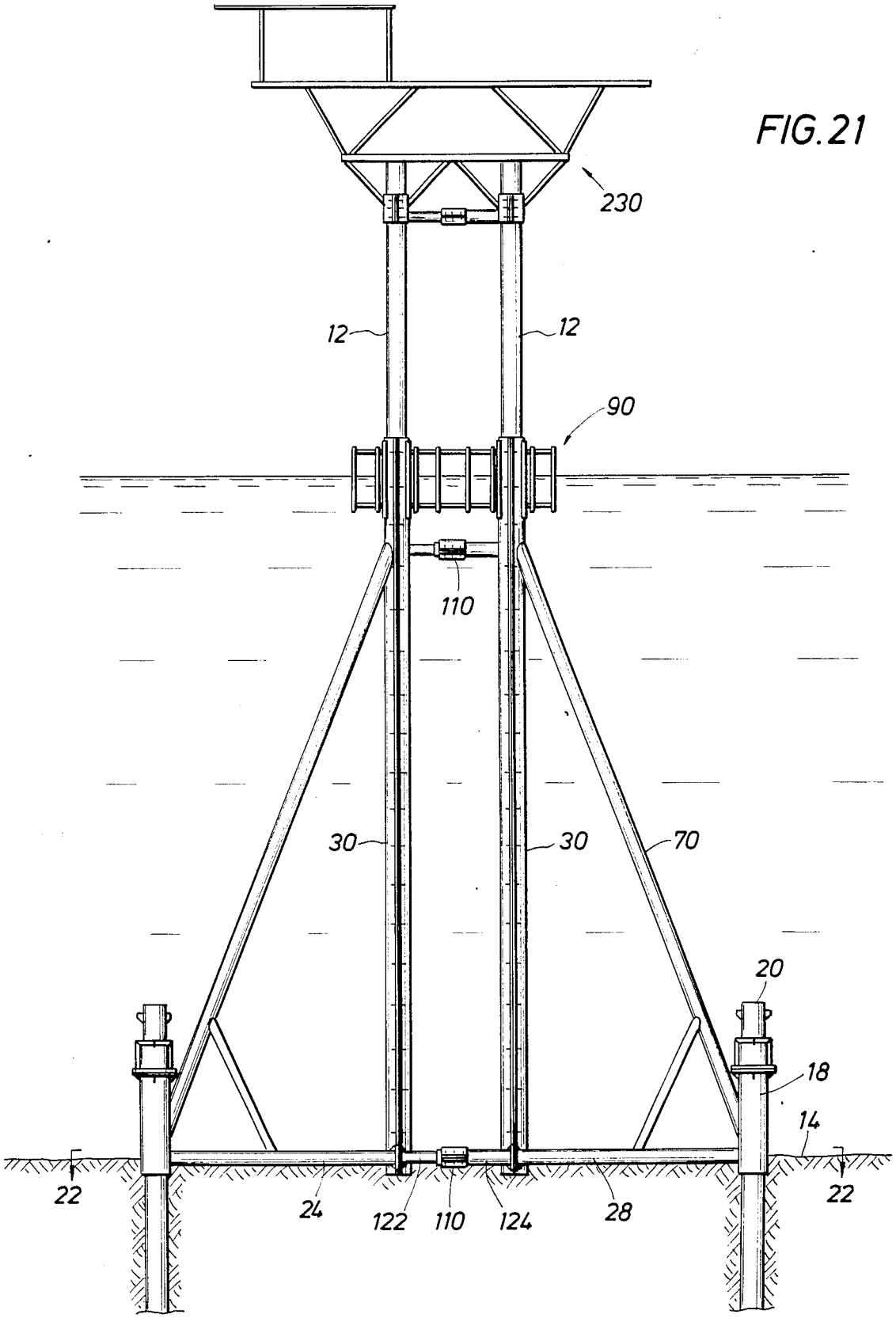
FIG. 21 is a side view of an alternate embodiment of the well support control system installed about two adjacent wells.
Figure 23:
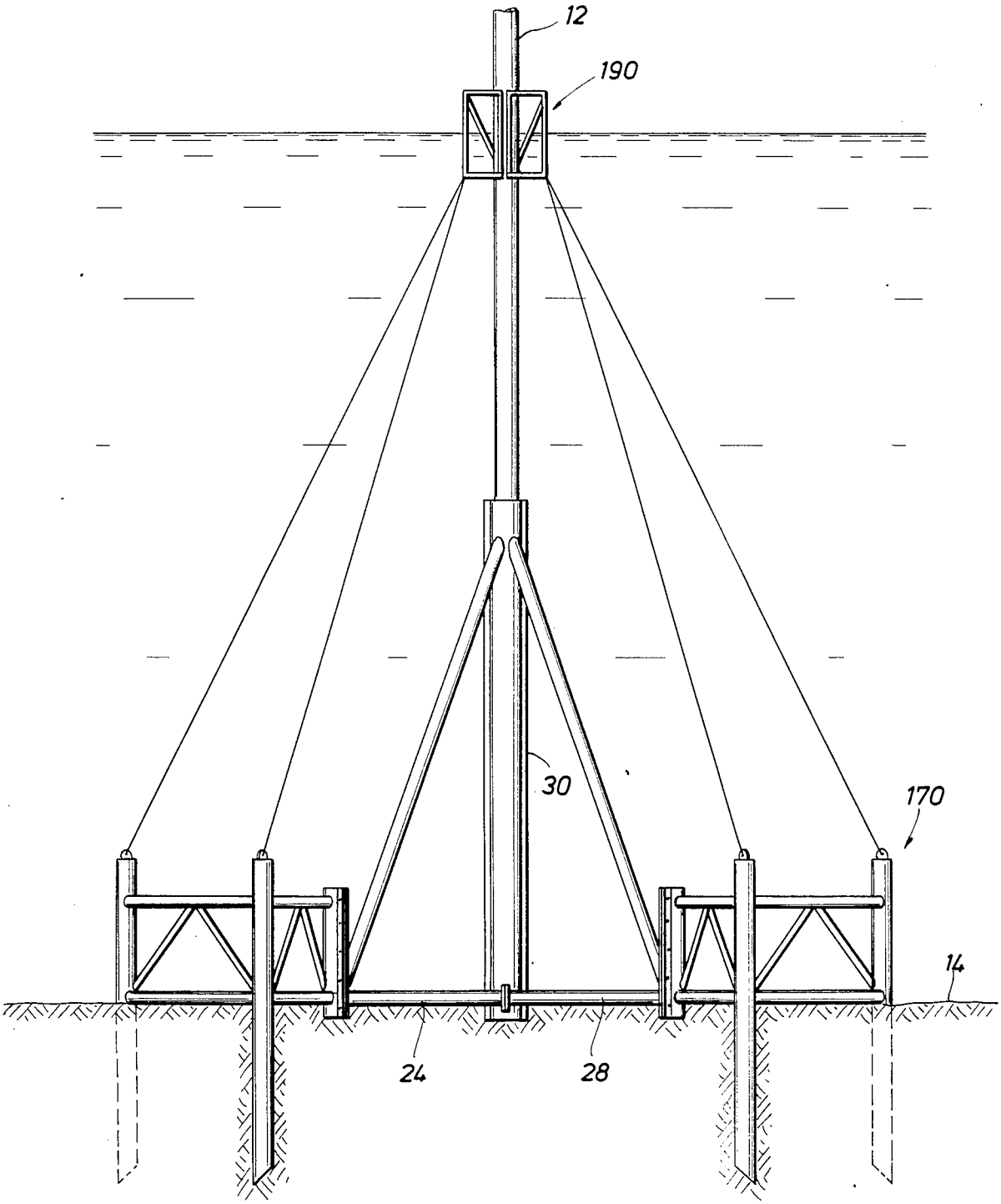
FIG. 23 is a side view of an alternate embodiment of the well support system of the disclosure for temporarily supporting a conductor pipe protruding from the seabed.

In FIGS. 21 and 22, a multi well embodiment of the well support system is shown. The modular design of the well support system permits the modules to be clamped together to support multiple wells. In FIG. 21, two vertical wells have been completed in a known manner. Recall that multiple wells are spaced closely and typically deviate below the seabed 14 by known directional drilling techniques. At the seabed 14, the wells may have similar conductor pipes 12 only a few feet apart. A conductor clamp 30 is mounted about each conductor pipe 12 in the manner previously described. Additional support is provided by the horizontally adjustable clamps 110 described in FIGS. 11–13. The horizontally adjustable clamps 110 are secured between the two conductor pipes 12 along the vertical length thereof to maintain a substantially constant spacing the full length of the conductor pipes 12. In the embodiment shown in FIGS. 21 and 22, three horizontally adjustable clamps 110, vertically spaced along the conductor pipes 12, are shown. It is understood, however, that additional clamps may be employed if desired. In the two well design, a larger deck may be mounted to the conductor pipes 12. The large deck 230 shown in FIG. 21 provides sufficient space for light workover units and limited production facilities. A cantilevered helideck may also be incorporated in the design of the deck providing accessibility to the well site by helicopter.

In FIGS. 23–27, a temporary well support system is shown. The well support system of FIGS. 23–27 is of particular usefulness for well sites requiring a complete production facility and require support for only a short period of time. In this embodiment, the conductor clamp 30 is installed in the manner described heretofore, however, an outrigger module 170 is incorporated in the design. One outrigger module 170 is secured to each corner as shown in FIG. 24. The piling sleeve at each corner comprises a split sleeve including split halves 172 and 174. The split half 172 is one half of the pile sleeve 18 shown in FIG. 1 and is connected to the diagonal and horizontal structural members of the conductor clamp 30. The mating split half 174 is connected to the outrigger module 170 which comprises horizontal and vertical structural members forming two spaced triangular frames. The triangular frames are parallel and spaced from each other. One point of the triangular members is connected to the sleeve half 174 and the remaining two points are connected to the outrigger legs 178 and 180. Angularly extending brace members 182 provide additional structural strength to form a rigid outrigger structure. Lifting eyes 184 are provided for lifting the outrigger modules 170 during assembly or disassembly of the temporary well support system. At the upper end of each of the legs 178 and 180, a cable securing eye 185 is provided. Upon installation of the conductor clamp 30, previously described, the outrigger modules 170 are positioned and the clamp halves 172 and 174 are bolted together about the piling anchoring the conductor clamp 30. The piling provides additional anchoring support and may be eliminated if desired. Sufficient anchoring support will be provided by the legs 178 and 180 of each outrigger module 170. Legs 178 and 180 may extend any desired distance into the seabed 14, as for example, 12–20 feet below the mud line. After the outrigger modules 170 are installed, cables 186 are secured to the cable securing eyes 185 and extended to the bottom of the boat landing 190 and connected thereto.

Adjustable turn buckle connectors may be used to adjust the tension in the cables 186.

Figure 27:
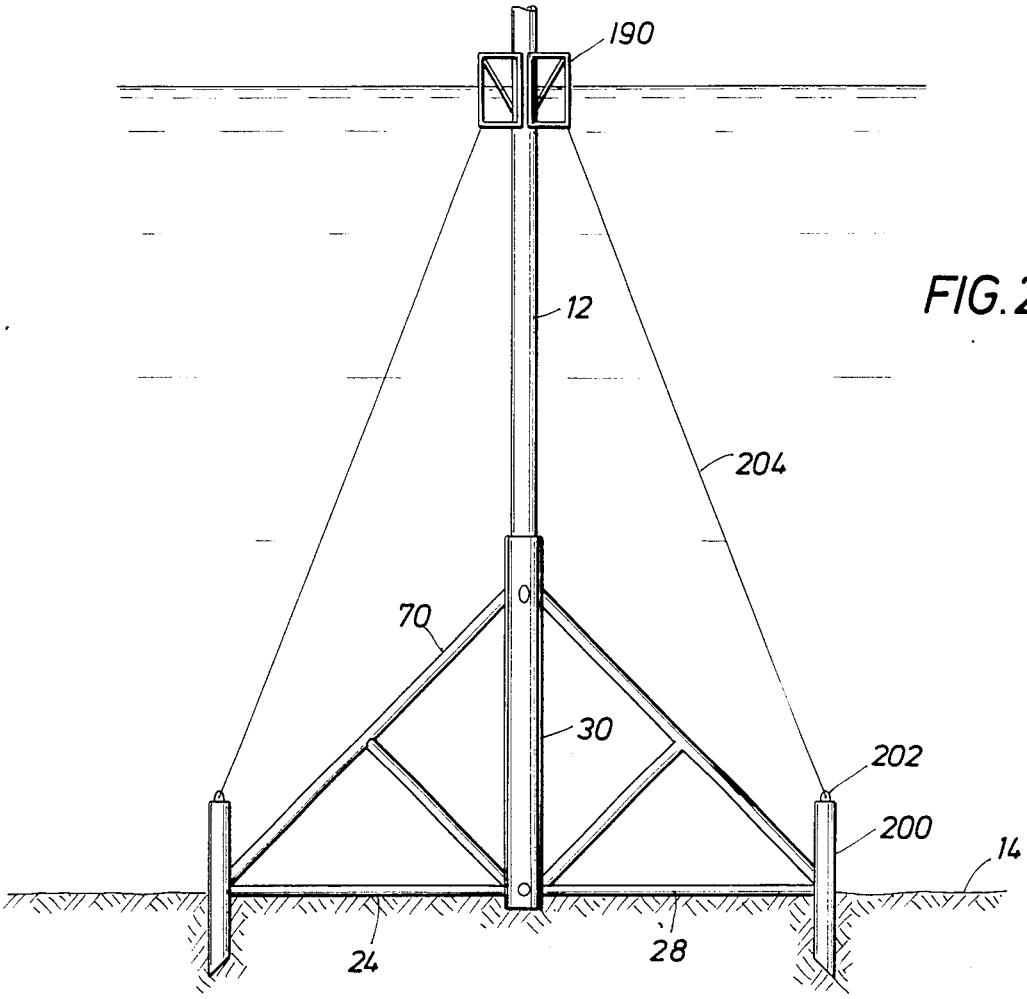
FIG. 27 is an alternate embodiment of the well support system of the disclosure for temporarily supporting a conductor pipe.

In the embodiment of FIG. 27, the outrigger modules have been eliminated and the conductor clamp 30 provided with anchor legs at each corner. The anchor legs 200, extend below the mud line to rigidly anchor the conductor clamp 30 in position. Cable eyelets 202 are provided at the upper end of the anchor legs which may extend up to ten feet or more above the seabed 14. Adjustable cables 204 are then connected between the cable eyelets 202 and the boat landing 190 to temporarily support the conductor pipe 12.

The temporary support systems shown in FIGS. 23–27 are easily and inexpensively fabricated, and include components of the well support system described heretofore. The system provides temporary and inexpensive support at a well site.

While the foregoing is directed to the preferred embodiments of the present invention, other and further embodiments of the invention may be devised without departing from the basic scope thereof, and the scope thereof is determined by the claims which follow.

I claim:

1. A protective well support system to be installed on an offshore well having an upstanding conductor pipe extending above the seabed, the system comprising:

(a) an upstanding conductor clamp adapted to encircle the conductor pipe, said conductor clamp formed by two upstanding facing members supported by a bottom engaging frame;

(b) said frame including a plurality of frame members joined together defining a substantially horizontal rectangular support frame for engaging the seabed;

(c) a plurality of angularly extending brace members secured at one end to said conductor clamp and at the other end to said frame;

(d) said conductor clamp being attached to said frame and extending upright thereabove to enable said conductor clamp to fasten about the conductor pipe;

(e) a boat landing mounted about the conductor pipe, said boat landing formed by at least two sectional components fixedly secured to semicircular clamp members adapted to encircle the conductor pipe for mounting said boat landing components thereon; and (f) well platform means supported on bracket means adapted to encircle the conductor pipe for removably securing said well platform means thereon.

2. The system of claim 1 wherein said frame, said boat landing, and said platform means are formed by modules releasably joining together to form the well support system.

3. The system of claim 1 wherein said boat landing comprises two separable frame units joined to said semiconductor clamp members to enable assembly around the well conductor pipe, one of said semicircular clamp members joined to each of said frame units.

4. The system of claim 1 wherein said frame includes horizontally extending leg members releasably joined together by adjustable clamp means, said adjustable clamp means including telescoping leg members secured by a split clamp.

5. The system of claim 4 wherein said adjustable clamp means includes an outer leg member slotted adjacent one end thereof to define a plurality of fingers and an inner leg member telescopingly received within said outer leg member, said fingers being compressed into gripping engagement with said inner leg member upon fastening said split clamp about said outer leg member.

6. The system of claim 1 wherein said frame includes peripherally located means for anchoring said frame to the seabed, said anchoring means including an upright hollow sleeve connected to said frame and anchor clamp means cooperative with said hollow sleeve for selectively gripping a piling inserted through said hollow sleeve into the seabed.

7. The system of claim 6 wherein said anchor clamp means comprises an interiorly threaded nut for threadably engaging an externally threaded portion on the piling extending through said hollow sleeve, said threaded nut including a flange portion for connection to a mating flange portion on said hollow sleeve.

8. The system of claim 4 wherein said adjustable clamp means comprises a threaded connection formed by a nut threadably mounted to an externally threaded portion on said inner leg member, said threaded nut including a flange for connection to a mating flange on said outer leg member.

9. The system of claim 1 wherein said frame is mounted to a subplatform adapted to encircle and clamp about the conductor pipe, said subplatform comprising two separable frame modules divided lengthwise enabling assembly around the well conductor pipe.

10. The system of claim 1 wherein said frame is adapted to be installed about two adjacent offshore wells having adjacent upstanding conductor pipes extending above the seabed, and wherein said conductor clamp includes an adjustable clamp component vertically positioned between the adjacent wells.

11. The system of claim 1 including a plurality of outrigger modules anchored about said frame, said outrigger modules connected to anchor means securing said frame to the seabed, and cable means extending from said outrigger modules and connected to said boat landing for temporarily supporting the conductor pipe.

12. The system of claim 1 wherein said conductor clamp defines an annular space about said conductor pipe, said annular space being filled by grout.

13. The apparatus of claim 8 wherein said mating flange on said outer leg member includes a plurality of slots enabling alignment with drilled holes in said flange on said threaded nut for receiving a connecting bolt therethrough.

14. The apparatus of claim 7 further including at least one weld stop welded on the interior of said hollow sleeve, said weld stop limiting the passage of the piling through said hollow sleeve and positioning of the threaded portion of the piling for engagement by said threaded nut.

15. The apparatus of claim 11 wherein said outrigger modules cooperate with said anchor means for securing said frame to the seabed, said anchor means comprising a split sleeve clamped about a piling extending into the seabed through said anchor means.

16. The apparatus of claim 6 wherein said hollow sleeve defines an annular space about the piling extending therethrough, said annular space being filled with grout.

17. The apparatus of claim 16 including a slip ring in sealing engagement about the piling, said slip ring connecting to said hollow sleeve and closing said annular space.

18. The apparatus of claim 17 wherein said hollow sleeve includes a tapped hole permitting air to be pumped into said annular space to remove water from said annular space, said tapped hole being plugged upon filling said annular space with grout.

19. The apparatus of claim 10 including an adjustable clamp component connecting said bracket means supporting said well platform means on at least two adjacent wells.

20. The apparatus of claim 1 wherein said frame includes peripherally located anchor legs for rigidly anchoring said frame to the seabed and including cable means extending from said anchor legs and connected to said boat landing for temporarily supporting the conductor pipe.

* * * * *